United States Patent [19]

Sutton

[11] 4,071,416

[45] Jan. 31, 1978

[54] TREATMENT OF CHROMIUM-CONTAINING IRON ALLOYS

[75] Inventor: William H. Sutton, Birmingham, England

[73] Assignee: The International Nickel Company, Inc., New York, N.Y.

[21] Appl. No.: 765,442

[22] Filed: Feb. 4, 1977

[30] Foreign Application Priority Data

Feb. 13, 1976 United Kingdom ..... 5779/76

[51] Int. Cl.[2] ..... C25D 11/00; C25D 5/00

[52] U.S. Cl. ..... 204/38 R; 204/56 R; 204/130

[58] Field of Search ..... 204/140, 56 R, 38 R, 204/130, 51; 148/6.2, 6.21

[56] References Cited

U.S. PATENT DOCUMENTS

| | | | |
|---|---|---|---|
| 2,312,066 | 11/1939 | Batcheller | 148/6.2 |
| 2,746,915 | 5/1956 | Giesker et al. | 204/56 R |
| 3,210,220 | 10/1965 | Cleg et al. | 148/6.21 |
| 3,437,532 | 4/1969 | Helgert et al. | 204/38 R |
| 3,755,117 | 8/1973 | Hart | 204/140 |
| 3,804,730 | 4/1974 | Evans et al. | 204/56 R |
| 3,832,292 | 8/1974 | Sutton et al. | 204/56 R |
| 3,850,767 | 11/1974 | Skedgell et al. | 204/56 R |

FOREIGN PATENT DOCUMENTS

| | | | |
|---|---|---|---|
| 1,099,836 | 1/1968 | United Kingdom | 204/140 |

*Primary Examiner*—R. L. Andrews
*Attorney, Agent, or Firm*—Francis J. Mulligan, Jr.; Ewan C. MacQueen

[57] ABSTRACT

A method of providing a hard film on stainless steel comprising treating the stainless steel in an aqueous solution of chromic and sulfuric acids to provide a film and then treating the metal containing the film in an aqueous solution of a water-soluble silicate for a period of time sufficient to harden the film.

6 Claims, No Drawings

TREATMENT OF CHROMIUM-CONTAINING IRON ALLOYS

This invention relates to the surface treatment of corrosion-resistant chromium-containing iron alloys, and is particularly applicable to stainless steel.

It is known to improve the appearance of such alloys by treatment in an aqueous solution of chromic and sulphuric acids, with or without other constituents, to form on the alloy surface a porous film which can exhibit colour by interference effects. Such films are however fairly soft, and to improve their resistance to abrasion, finger-marking and staining it is necessary to harden them. This can be done by cathodic electrolysis of the alloy bearing the film in a suitable electrolyte from which deposits are formed in pores in the film. Such processes are described for example in the following U.S. patents the disclosure of which are incorporated herein by reference herein:

| U.S. Pat. No. | Inventor | Date |
|---|---|---|
| 3,839,096 | Skedgell et al | October 1, 1974 |
| 3,804,730 | Evans et al | April 16, 1974 |
| 3,755,117 | Hart | August 28, 1973 |
| 3,766,023 | Hart | October 16, 1973 |
| 3,850,767 | Skedgell et al | November 26, 1974 |
| 3,832,292 | Evans et al | August 27, 1974 |

Surprisingly, I have now found that such films may be hardened without necessarily using cathodic electrolysis. It is the object of the present invention to provide a novel process for hardening films on chromium-containing corrosion resistant iron alloys. Other objects and advantages of the present invention will become apparent from the following description.

The present invention provides a method of providing a hard film on the surface of a corrosion-resistant chromium-containing iron alloy comprising treating the alloy in an aqueous solution of chromic and sulphuric acids, with or without other constituents, to provide a film in the alloy and thereafter treating the alloy bearing the film in an aqueous solution of water soluble silicate for a period of time sufficient to harden the film.

The hardness increases to a maximum with increasing time of treatment and the treatment time of course should be long enough to ensure adequate hardening.

Preferably the water soluble silicate is sodium silicate. Moreover, the treatment in the aqueous solution of water soluble silicate should preferably be carried out at a solution temperature in excess of room temperature, more preferably in the temperature range of from 60° C to the boiling point of the solution. Satisfactory treatment times preferably are of the order or at least 5 minutes or more such as, for example, 10, 20, 30 and even 40 minutes.

Although the process of the invention used alone effects a substantial improvement in the hardness of an untreated film, I find that it further increases the hardness of films that have been subjected to the conventional cathodic electrolytic hardening treatment in which the alloy bearing the film is subjected to electrolysis as the cathode in a hardening electrolyte, which preferably is an aqueous solution of chromic acid and phosphoric acid, and according to a preferred embodiment of the invention these two treatments are successively applied.

For comparison purposes 50 millimeter square samples of mirror-finished Type 304 stainless steel (18 to 20% chromium, 8 to 12% nickel) were colored blue by immersion for approximately 12 minutes in an aqueous solution containing 250 g/l (grams per liter) of chromic acid and 500 g/l of sulfuric acid at 80° C. Some of the colored samples were then hardened by a typical conventional cathodic electrolysis method involving cathodic electrolysis for 10 minutes at a current density of 0.4 A/dm$^2$ (amperes per square decimeter) in an aqueous solution containing 250 g/l chromic acid and 2.5 g/l phosphoric acid at 20° C.

Some samples (A) bearing the unhardened blue film and others (B) bearing the conventionally hardened blue film were then tested for resistance to abrasion by two different tests. The first test was a so-called rub test in which the film surface was rubbed with a pencil type eraser loaded with a 600 gram weight; the number of rubs to failure of the film being a measure of the hardness. The second test was a so-called sliding ball test in which the film surface was rubbed against a loaded 0.5 millimeter diameter steel ball; the load on the ball at which scratching of the film first occurred being a measure of the hardness. The hardness results are shown in the following Table I.

TABLE I

| Sample | Sliding ball test load in grams to scratch | Rub test No. of rubs to failure |
|---|---|---|
| A | 10 | 10 |
| B | 20 | 130 |

From the results shown in Table I for Samples A and B, both treated according to the methods outside the scope of the present invention, the hardened blue film (Sample B) showed that the conventional hardening treatment increased the hardness of the blue film (Sample A), but with an apparently lower increase in scratch resistance than in rubbing resistance.

Further blue-colored samples prepared in the same way as Samples A and B were then treated in Tests 1 to 4 according to the invention by immersion in a solution of a water soluble silicate, namely sodium silicate, using a solution made up from a standard solution containing 18% W/W $Na_2O$ and 36% W/W $SiO_4$ with treatment conditions and test results as shown in the following Table II.

TABLE II

| Test | Sample Type | Solution Strength Wt.% of Standard | Immersion time in minutes | Solution temperature ° C | Sliding test load in grams to scratch | Rub test No. of rubs to failure |
|---|---|---|---|---|---|---|
| 1 | A | 0.5 | 10 | 60 | 500 | 400 |
| 2 | A | 1.0 | 5 | B.P. | 3000 | 400 |
| 3 | B | 0.5 | 10 | 60 | 2000 | 600 |
| 4 | B | 1.0 | 5 | B.P. | 3000 | 1000 |

B.P. = Boiling point.

From the results of Tables I and II it can be seen that the hardness and thus the abrasion resistance both in terms of scratch resistance and rub resistance, of both unhardened and conventionally hardened blue films, was greatly increased by treatment according to the present invention. Good results were obtained with immersion times of the order of 5 minutes in a solution 1.0 wt. % of the standard solution at boiling point and these conditions are preferred. It is more preferable to apply the treatment according to the present invention to films already conventionally hardened than to an unhardened film as can be seen from the results of Table II.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A method of providing a hard film on the surface of a stainless steel comprising treating the stainless steel in an aqueous solution of chromic and sulphuric acids, with or without other constituents to provide a film on the surface thereof, without heat treating the film subjecting the stainless steel bearing the film to electrolysis as the cathode in a hardening electrolyte and thereafter treating the stainless steel bearing the hardened film in an aqueous solution of a water soluble silicate for a period of time of at least about 5 minutes sufficient to harden the film.

2. A method according to claim 1, in which the treatment in the aqueous solution of a water soluble silicate is carried out at a solution temperature in excess of room temperature.

3. A method according to claim 2, in which the solution temperature is in the range of from 60° C to the boiling point of the solution.

4. A method according to claim 1, in which the water soluble silicate utilized is sodium silicate.

5. A method according to claim 1, in which the hardening electrolyte is an aqueous solution of chromic acid and phosphoric acid.

6. A stainless steel article having on a surface thereof a film increased in hardness by the method according to claim 1.

* * * * *